US009744469B2

(12) United States Patent
Kitchen

(10) Patent No.: US 9,744,469 B2
(45) **Date of Patent: *Aug. 29, 2017**

(54) TOWER RIDE

(71) Applicant: William J Kitchen, Windermere, FL (US)

(72) Inventor: William J Kitchen, Windermere, FL (US)

( * ) Notice: Subject to any disclaimer, the term of this patent is extended or adjusted under 35 U.S.C. 154(b) by 124 days.

This patent is subject to a terminal disclaimer.

(21) Appl. No.: 14/693,776

(22) Filed: Apr. 22, 2015

(65) Prior Publication Data

US 2015/0224410 A1 Aug. 13, 2015

Related U.S. Application Data

(63) Continuation of application No. 13/947,236, filed on Jul. 22, 2013, now Pat. No. 9,016,210, which is a continuation of application No. 13/640,009, filed as application No. PCT/US2012/039735 on May 25, 2012, now Pat. No. 8,490,549.

(60) Provisional application No. 61/490,135, filed on May 26, 2011, provisional application No. 61/554,865, filed on Nov. 2, 2011, provisional application No. 61/616,585, filed on Mar. 28, 2012.

(51) Int. Cl.

| | |
|---|---|
| ***A63G 1/00*** | (2006.01) |
| ***A63G 21/10*** | (2006.01) |
| ***A63G 7/00*** | (2006.01) |
| ***A63G 21/04*** | (2006.01) |

(52) U.S. Cl.

CPC ..... *A63G 21/10* (2013.01); *A63G 7/00* (2013.01); *A63G 21/04* (2013.01)

(58) Field of Classification Search

CPC ..... A63G 1/00; A63G 7/00

See application file for complete search history.

(56) References Cited

U.S. PATENT DOCUMENTS

| | | | |
|---|---|---|---|
| 728,246 | A | 5/1903 | Kremer |
| 771,322 | A | 10/1907 | Pattee |
| 944,407 | A | 12/1909 | Beebe |
| 1,347,968 | A | 7/1920 | O'Doie |
| 1,748,184 | A | 3/1928 | Nichols |
| 2,128,492 | A | 4/1937 | Mena |
| 2,423,283 | A | 7/1947 | Austin |

(Continued)

FOREIGN PATENT DOCUMENTS

| | | | |
|---|---|---|---|
| BE | 459804 | A | 9/1945 |
| CN | 2284633 | Y | 6/1998 |

(Continued)

OTHER PUBLICATIONS

Examination Report dated May 17, 2016 in related Japanese national phase application 711413.

(Continued)

*Primary Examiner* — R. J. McCarry, Jr.

(74) *Attorney, Agent, or Firm* — Polson Intellectual Property Law, PC; Margaret Polson

(57) ABSTRACT

A tower ride is disclosed with suspended cars mounted on rails that that forms track that is a complete double helix path for the car without having to turn the car or switch tracks. The car is suspended from a four truss track, riding on the two bottom rails for stability. Another embodiment is a roller coaster track mounted on a tower.

18 Claims, 23 Drawing Sheets

(56) References Cited

U.S. PATENT DOCUMENTS

| | | | | |
|---|---|---|---|---|
| 3,299,565 | A | 1/1967 | Yarashes | |
| D218,246 | S | 8/1970 | House | |
| D255,138 | S | 5/1980 | Sermersheim | |
| 4,988,089 | A | 1/1991 | Knijpstra | |
| 5,247,847 | A | 9/1993 | Gu | |
| 5,628,690 | A | 5/1997 | Spieldiener et al. | |
| 5,893,802 | A | 4/1999 | Bohme | |
| 6,047,645 | A | 4/2000 | Cornwell et al. | |
| 6,755,749 | B2 | 6/2004 | Stengel | |
| 6,953,377 | B2 | 10/2005 | Quercetti | |
| 8,490,549 | B2 * | 7/2013 | Kitchen | A63G 21/10 104/53 |
| 9,016,210 | B2 | 4/2015 | Kitchen | |
| 2006/0137563 | A1 | 6/2006 | Cummins | |

FOREIGN PATENT DOCUMENTS

| | | | |
|---|---|---|---|
| DE | 377094 | A | 6/1923 |
| DE | 406720 | A | 11/1924 |
| DE | 10321696 | A1 | 12/2004 |
| EP | 0360334 | A1 | 3/1990 |
| FR | 2599988 | | 12/1987 |
| JP | H02158504 | A | 6/1990 |
| JP | 2002-143569 | | 5/2002 |
| JP | 2003-003681 | A | 1/2003 |
| JP | 2003-024647 | | 1/2003 |
| JP | 2004167067 | A | 6/2004 |
| JP | 2008-188384 | | 8/2008 |
| NZ | 552068 | | 5/2004 |
| WO | 02/085478 | | 10/2002 |

OTHER PUBLICATIONS

Examination Report dated Aug. 8, 2016 in related Australian national phase application 2012258564.

European Search Report in related application EP15167821.6 dated Oct. 9, 2015.

International Search Report in international application No. PCT/US2012/039735 mailed Sep. 14, 2012.

Written Opinion in international application No. PCT/US2012-039735 mailed Sep. 14, 2012.

Extended European Search Report dated Oct. 2, 2014 in related European application 12789369.1.

Examination Report dated Sep. 9, 2015 in related New Zealand national phase application 711413.

Office action dated Mar. 17, 2017 in related Chinese patent application 201610113753.2.

Office action dated Apr. 6, 2017 in related Korean patent application 10-2013-7033752.

Office action dated Apr. 6, 2017 in related Korean patent application 10-2016-7033453.

* cited by examiner

TOWER RIDE

CROSS REFERENCE APPLICATIONS

This application is a continuation of application Ser. No. 13/947,236 filed Jul. 22, 2013, which is a continuation of application Ser. No. 13/640,009 filed May 25, 2012, which is a National Stage of PCT/US2012/039735 non-provisional application claiming the benefits of provisional application No. 61/490,135 filed May 26, provisional application no. 61/554,865 filed Nov. 2, 2011, and provisional application No. 61/616,585 filed Mar. 28, 2012, each of which is hereby incorporated by reference for all purposes.

BACKGROUND

Amusement rides with tracks on towers are known in the art. One of the issues with the prior art rides are that they do not have the same length of ride up the tower as down and that the tower blocks the view of the riders. One solution is to spiral the track up a tower. However, in the prior art tower rides, the difficulty of getting the car back down the tower without flipping the car or just bring the track straight down the side is presented. What would be more desirable is to have the track spiral both up and down the tower, allowing for a longer track in a small space and to allow for the possibility of having the ride up and the ride down be separate rides of equal length. Also, there is a desire to have more traditional roller coasters in as small of footprint as possible.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present disclosure is to have a tower ride that has both an upward and a downward track that spirals around the tower.

Another aspect of the present disclosure is to have a tower ride that is similar to a roller coaster.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

One embodiment of the disclosed ride is a tower ride with suspended cars that forms a complete double helix path for the car without having to turn the car or switch tracks. The car is suspended from a four truss track, riding on the two bottom rails for stability. The tightness of the helix turns can be chosen from a wide range of options to allow the designer to choose the height of the tower, speed of the cars and the total length of the ride.

Another embodiment of the disclosed tower rider is a coaster type tower rider with one section of the track being a driven section that carries the rider carriage to the top of the tower and the other section being a downward section that the rider carriages roll down as is a traditional coaster.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
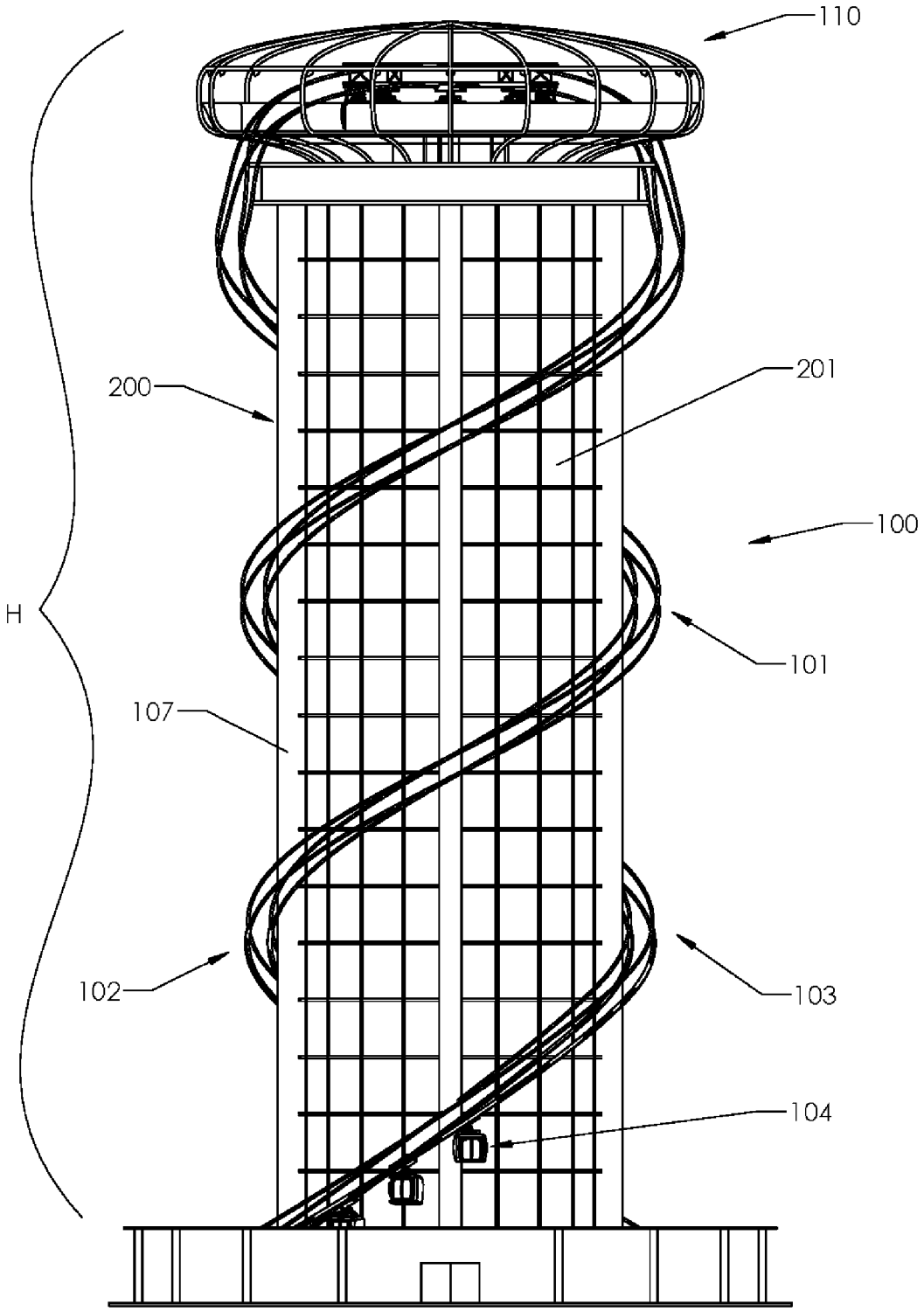
FIG. 1 is a side elevation view of a tower ride on the outside of a building such as a hotel.

FIG. 1 is a perspective view of a tower amusement ride 100 with a track 101 forming a double helix around the body 201 of the tower 200. In the depicted embodiment the body 201 of the tower is a building such as a hotel or other high rise building. The amusement ride 100 could also be built on an open tower structure. The track 101 has a first helix section 102 to support the rider carriages 104 going one direction up or down on body of the tower and a second helix section 103 to support the rider carriages going the other direction on the body of the tower. In the depicted embodiment section 102 is the upward section and 103 is the downward section. However, this is for illustrative purposes only. Depending on the design of the propulsion system, it may be possible to reverse the direction of travel of rider carriages if desired. Which section 102 or 103 is set up as the upward section and which section is the downward section make no difference in the operation of the ride, unlike with prior art rides. First and second helix sections are substantially parallel to each other for a majority of the height H of the body of the tower in the depicted embodiment. The first helical section 102 and second helix section 103 are evenly spaced apart in the depicted embodiment, however as long as there is enough room between the two sections to prevent the rider carriages 104 from coming into contact with the track section below it, other configurations are possible, including not running the track sections parallel, allowing for a wide variety of possible design looks to the ride 100.

The track 101 is formed on a four-cord truss in the depicted embodiment The four-cord truss is formed of four rails 111, 112, 113 114. The four rails are linked together with supports 116. In the majority of the views of the track 102 the supports that link the rails together are not shown to allow for easier viewing of the rails of the track. The number and spacing of the supports on the track 101 will be determined by standard engineering considerations such as weight of the rider carriages, number of rider carriages 104 on the track 101 and the maximum loading that will be allowed in the rider carriages.

Figure 2:
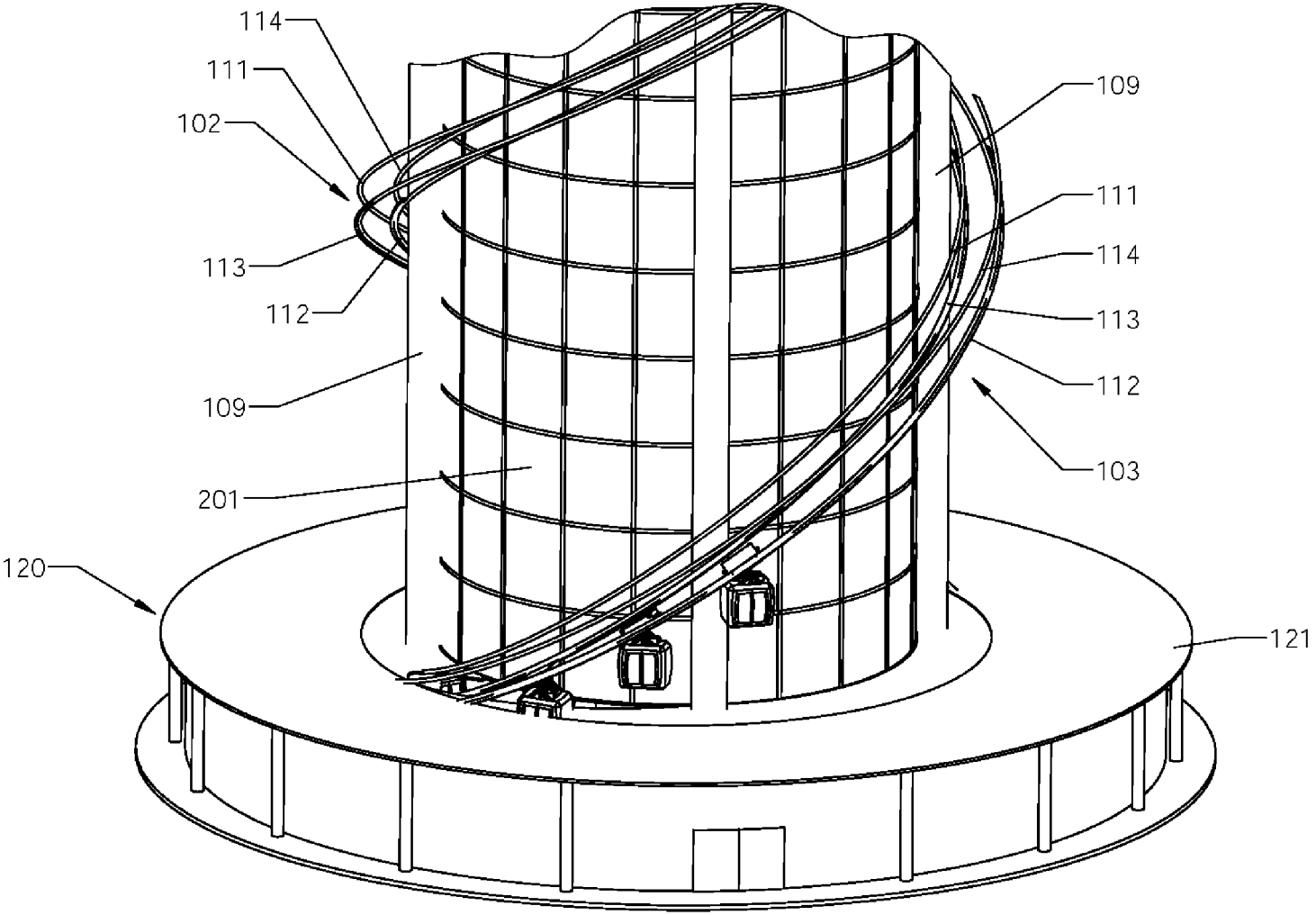
FIG. 2 is a perspective view of the base of the tower ride.
Figure 3:
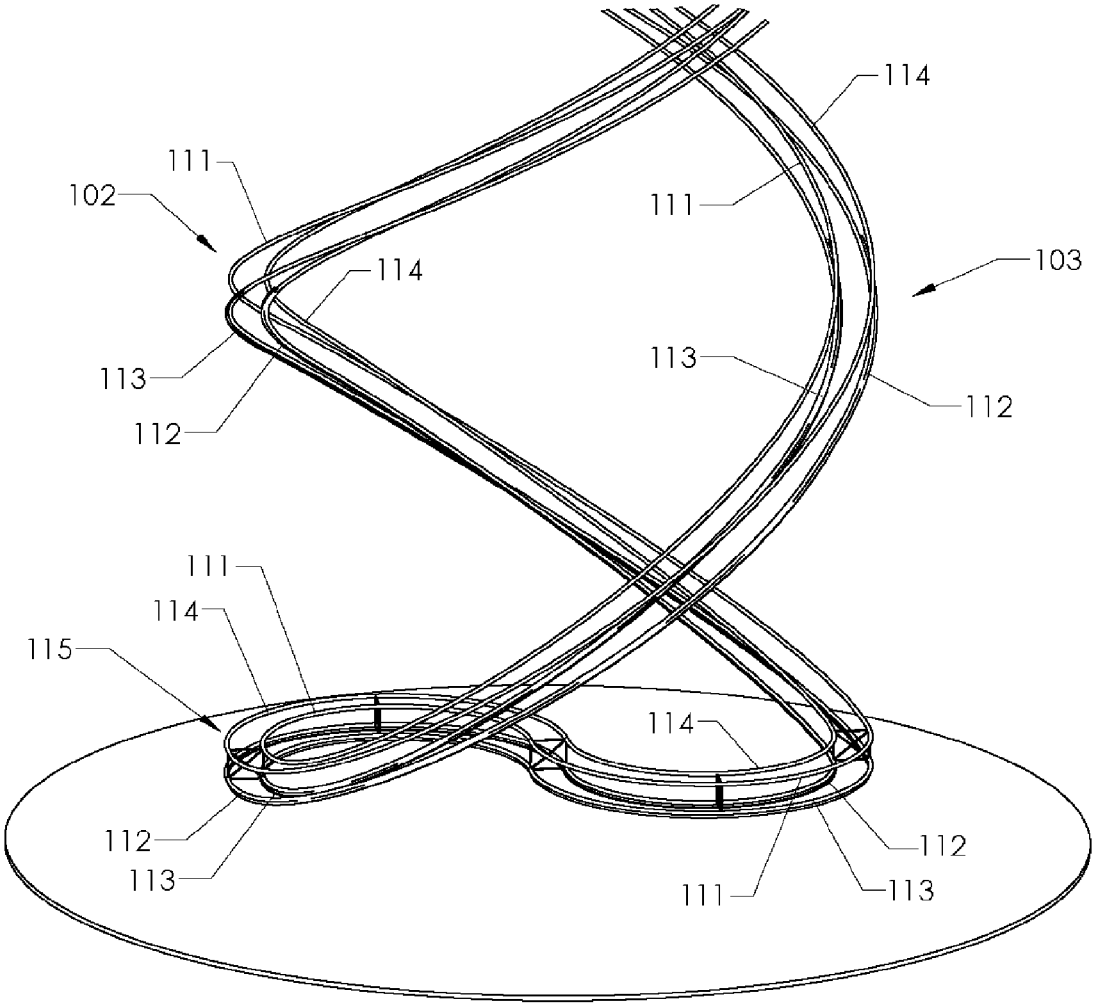
FIG. 3 is a view of the track in the base of the tower ride.

Referring next to FIGS. 2 and 3, at the base of the tower there is a loading area inside of the building 120. Rails 112, 113 are the first and second bottom rails of the track 101 respectively and support the rider carriage 104. Rails 111, 114 form the top of the track 101 and are the first and second top rails respectively. Rails 112, 114 are the inner rails of track and rails 113 111 are the outer rails of the track in the first helix section 102. The outer rails are located radially outward from the inner rails and are substantially parallel to the inner rails. At the bottom of the tower the two helix sections are joined by a first S curve 115 of track that turns the orientation of the four-cord truss so that on the second helix section 103 rails 112, 114 are the outer rails and rails 113, 111 are the inner rails, as seen in FIG. 3. The first bottom rail 112 becomes the outer bottom rail and the second bottom rail 113 becomes the inner bottom rail. This S curve 115 allows the two helical sections 102 and 103 to be joined together without having to switch to a different track, change the orientation of the rider carriage with respect rails 112, 113 or any other solution shown in the prior art. The S curve is a switch back section of track that changes the orientation of the track and consequently the rider carriage. This means that a first side of the rider carriage is facing outward on the first helical section of the track and a second side of the rider carriage is facing outward on the second helical section of the track, the first and second sides of the ride carriage being opposite each other. The double helix configuration allows for a much longer track 101 in a given space, allowing for a much longer ride time. This double helix configuration allows a ride with a long ride time and significant vertical climb in a very limited ground foot print, which is often highly desirable in cities and/or amusement parks that want as many rides as possible in their limited ground space.

Figure 4:
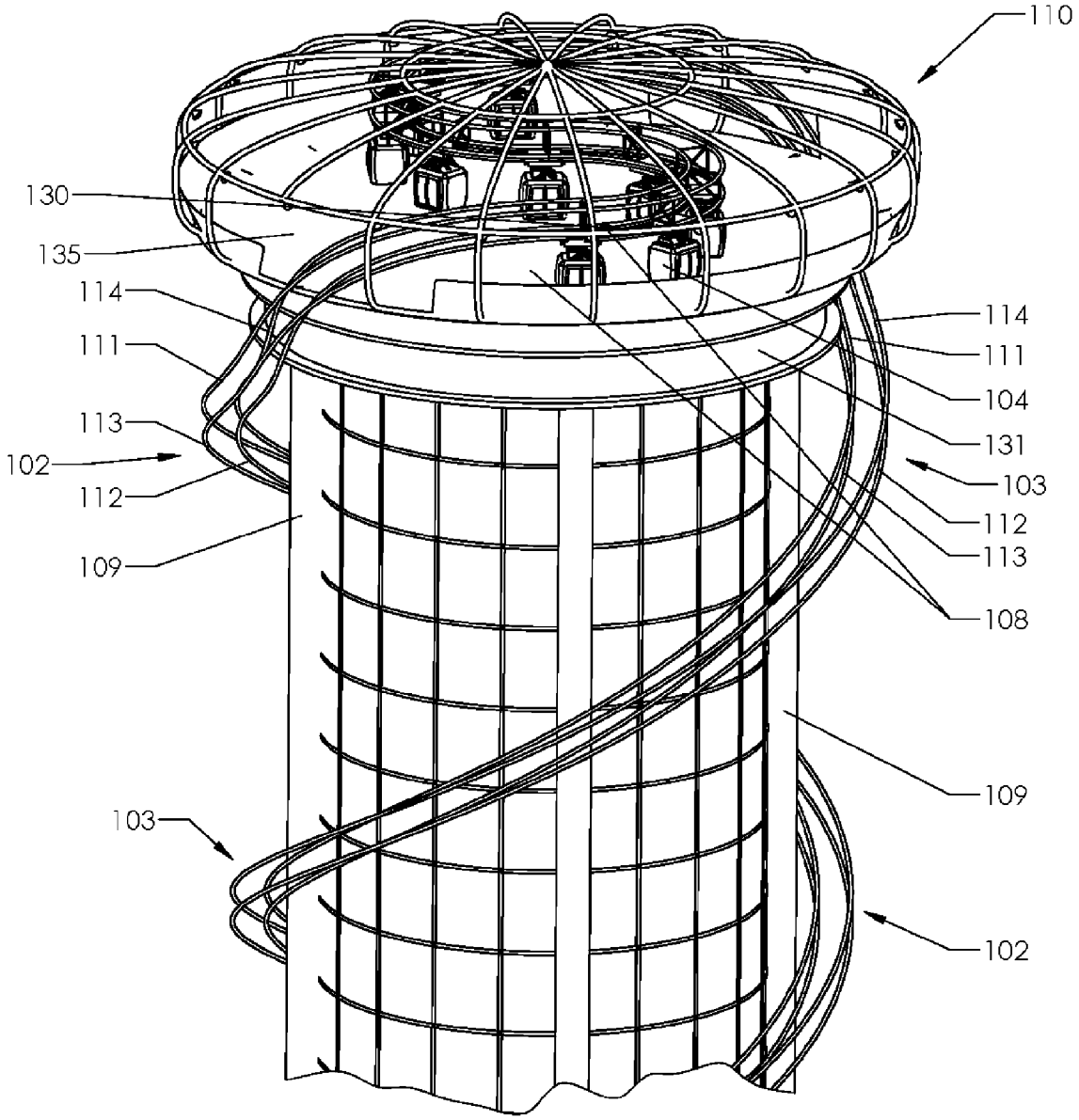
FIG. 4 is a perspective view of the top of the tower ride.
Figure 5:
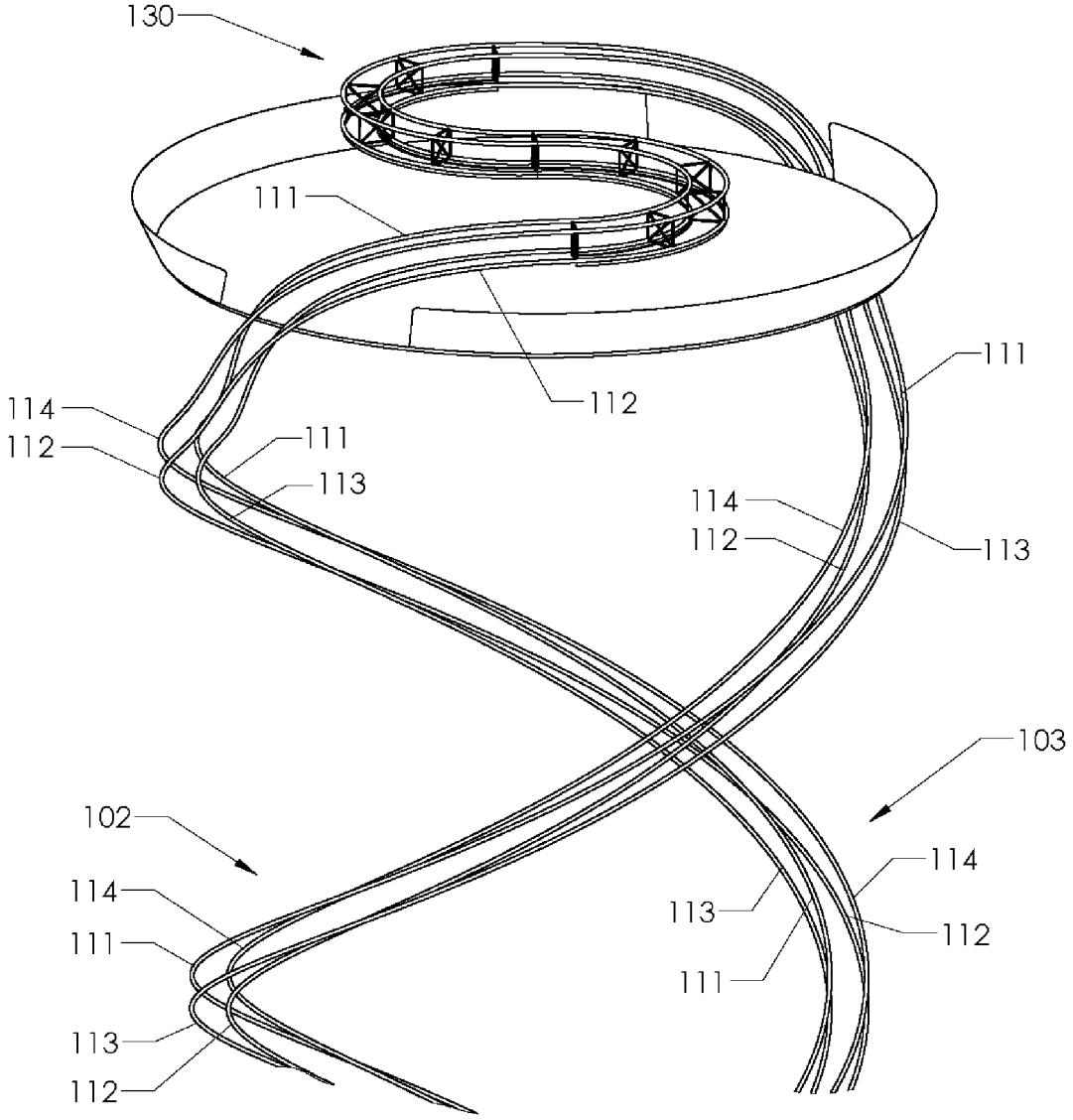
FIG. 5 is a perspective view of the track in the top of the tower ride.

Referring next to FIGS. 4 and 5, a second S curve section 130 joins the two helix sections 102, 103 at the top of the tower. The second S curve again changes which rails are on the outside and inside of the track 101 as discussed in relation to first S curve section 115, completing smooth loop with no changes of track needed and allowing a helical track in both directions. The area at the top of the tower 110 that the rider carriages 104 move over has a floor 135. If desired, the ride can be configured to allow riders out at the top of the tower 110. As a result of the S curve sections, the rider carriage will have a first side facing outward on the first helical section 102 of track and a second side facing outward on the second helical section 103 of track 101.

Figure 6:
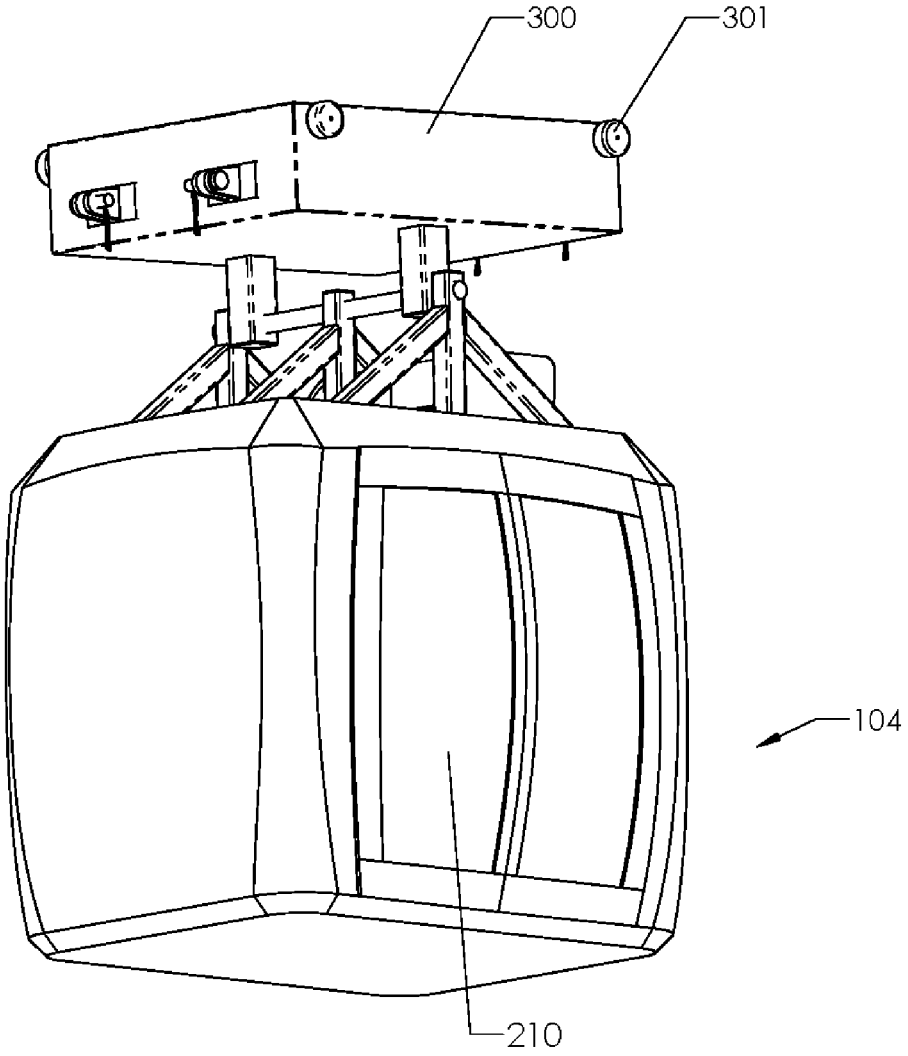
FIG. 6 is a perspective view of a rider carriage.
Figure 7:
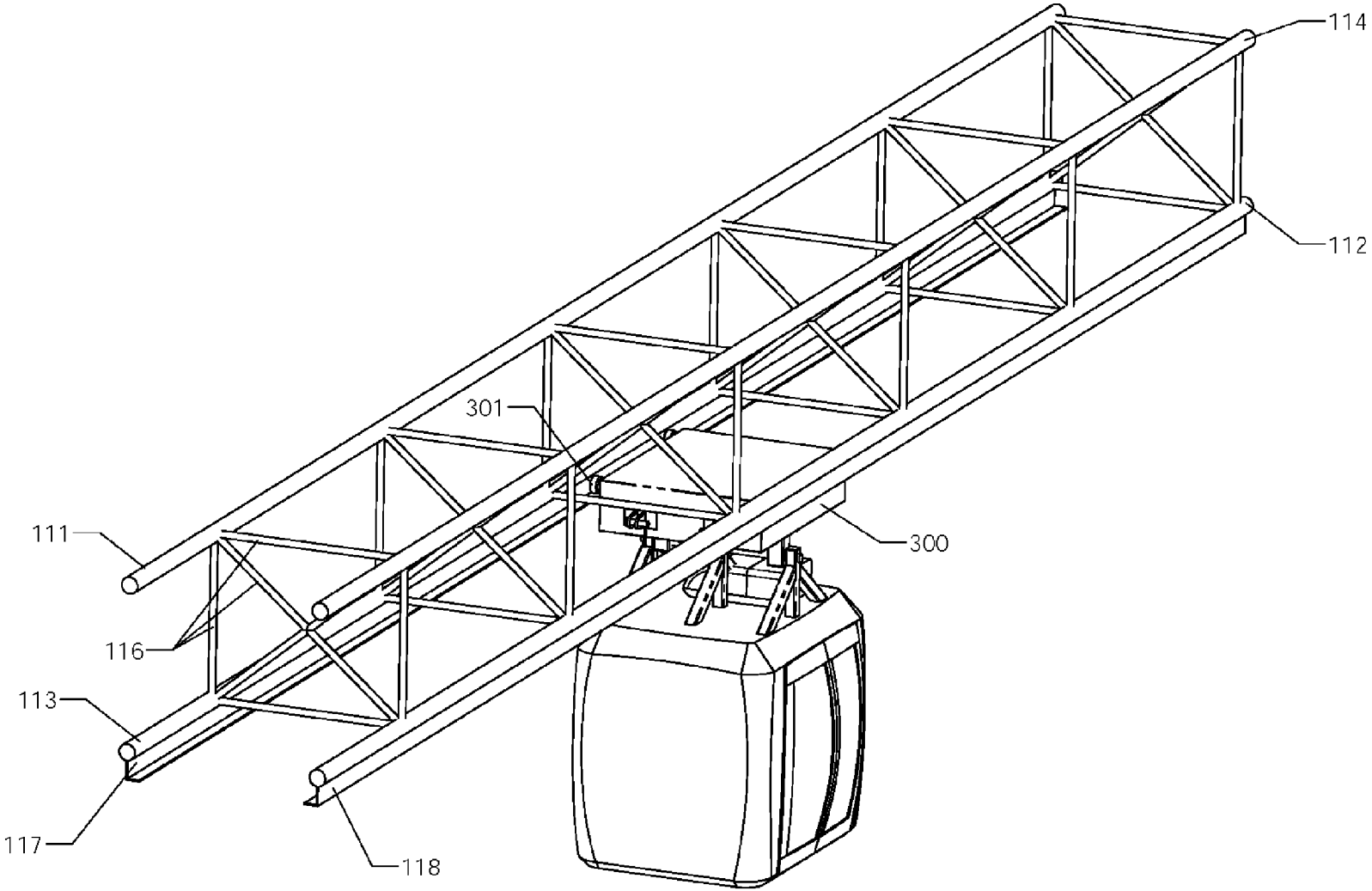
FIG. 7 is a perspective view of the rider carriage on a section of track.
Figure 8:
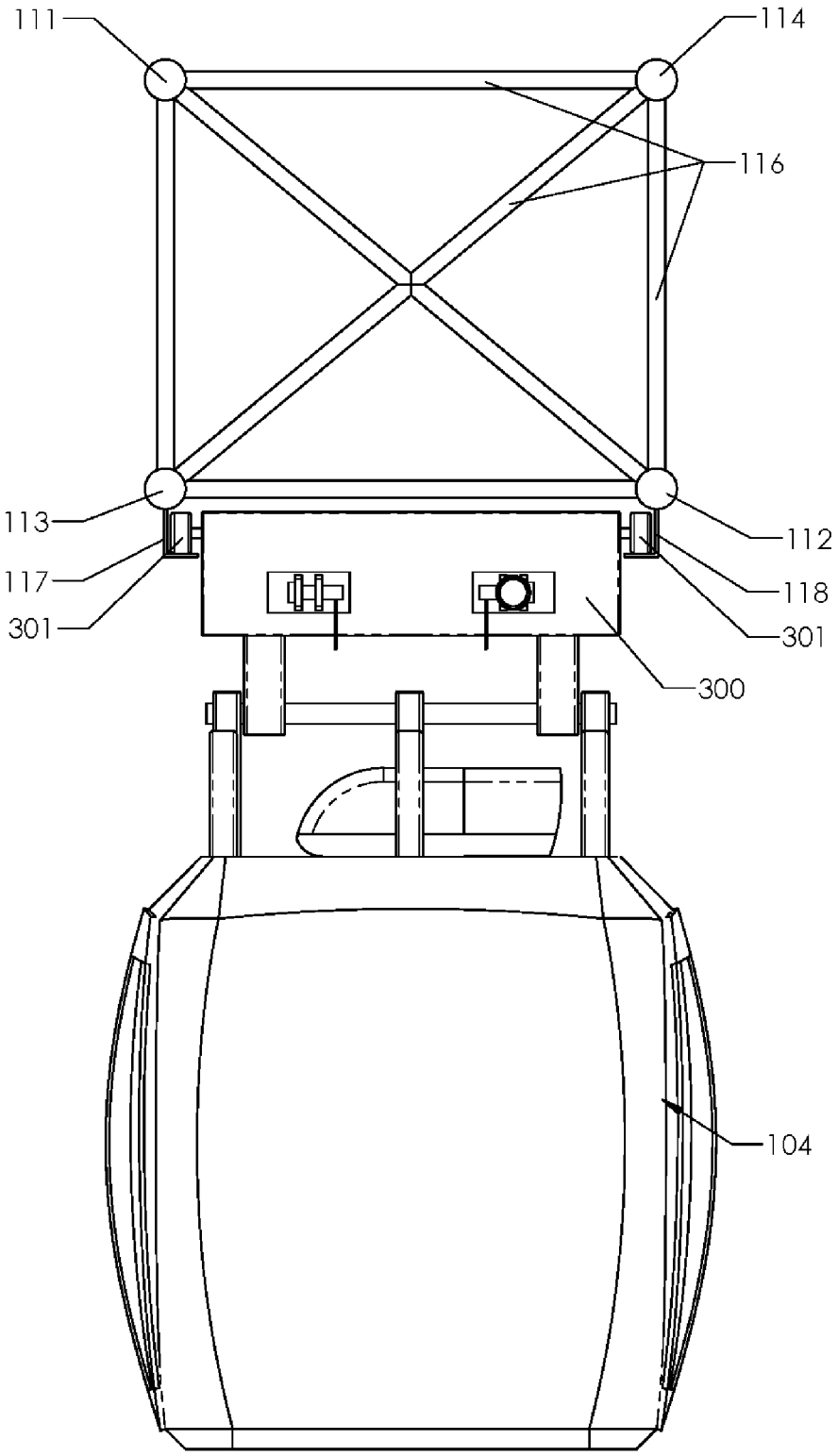
FIG. 8 is a side elevation view of the rider carriage on the track.

FIGS. 6, 7 and 8 show the rider carriage 104. L shaped rails 117, 118 are extended from the bottom of rails 112, 113 as seen in FIGS. 7 and 8. A tri-cord truss (not shown) could be used as well, so long as two rails of the truss formed the bottom two rails 12, 113 with the third rail above them.

The rider carriage has a mounting section 300 with wheels 301 that ride along the L shaped rails 117, 118. Other methods of mounting the rider carriage to the rails could be used as well, depending on the design of the ride. In the depicted embodiment, there are four wheels 301, but more or less could be chosen depending on the design of the ride. The rider carriage 104 is pivotally mounted below mounting section 300. In the depicted embodiment a simple axle pivot design in show. Other possible mounting methods could be used as well. Depending on the design of the ride, the rider carriages 104 can move at a constant speed that is slow enough for riders to board, or the rider carriages may slow down and/or stop in the loading area. The rider carriages 104 may be attached together in a continuous loop or may be separately attached to the rail with no connections between them. If they are separately attached it may be desirable to have a safely mechanism that would prevent the rider carriages 104 from getting to close together and/or running into each other. The rider carriages 104 could be individually driven around the track, driven by a chain, cable driver, rack and pinion or other driving mechanisms. The rider carriages 104 have doors 210 on both sides of the rider carriage 104, allowing the riders to enter and/or exit from either side of the rider carriage 104. Given the change of orientation of the rider carriage 104 as it moves through the S curves at the top and bottom of the ride, this allows the riders to always exit on the outer side of the track. In most configurations it will be desirable for riders to be exiting on the outer side of the track, as this will mean that the riders will most likely not be crossing the track, which has inherent dangers. If it was desirable at some location to have the riders enter on the inner side of the track, overpasses or under passes could be constructed in the building to get the riders to the inside of the track without having them be in the path of the rider carriages.

Figure 9:
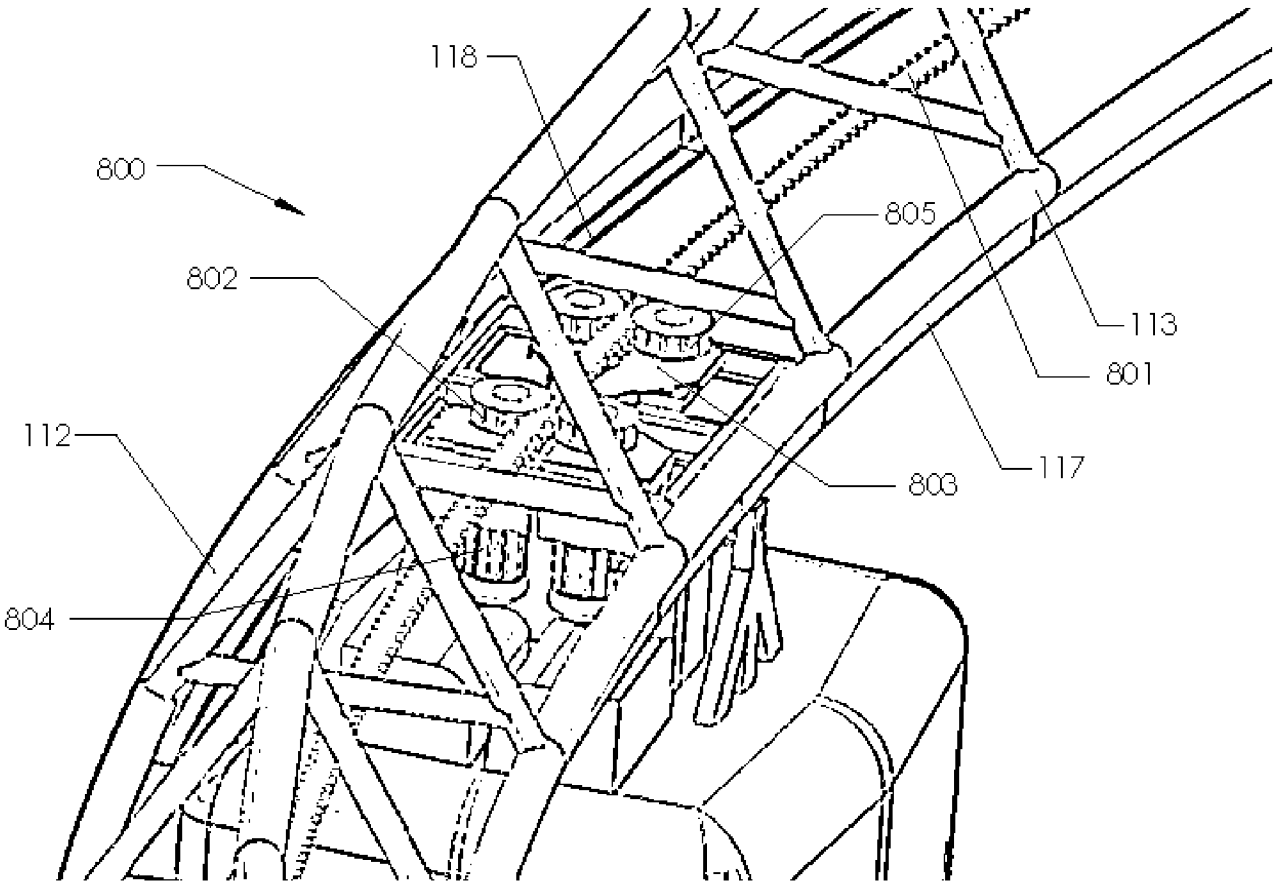
FIG. 9 is a perspective view of a rack and roller pinon drive system.
Figure 10:
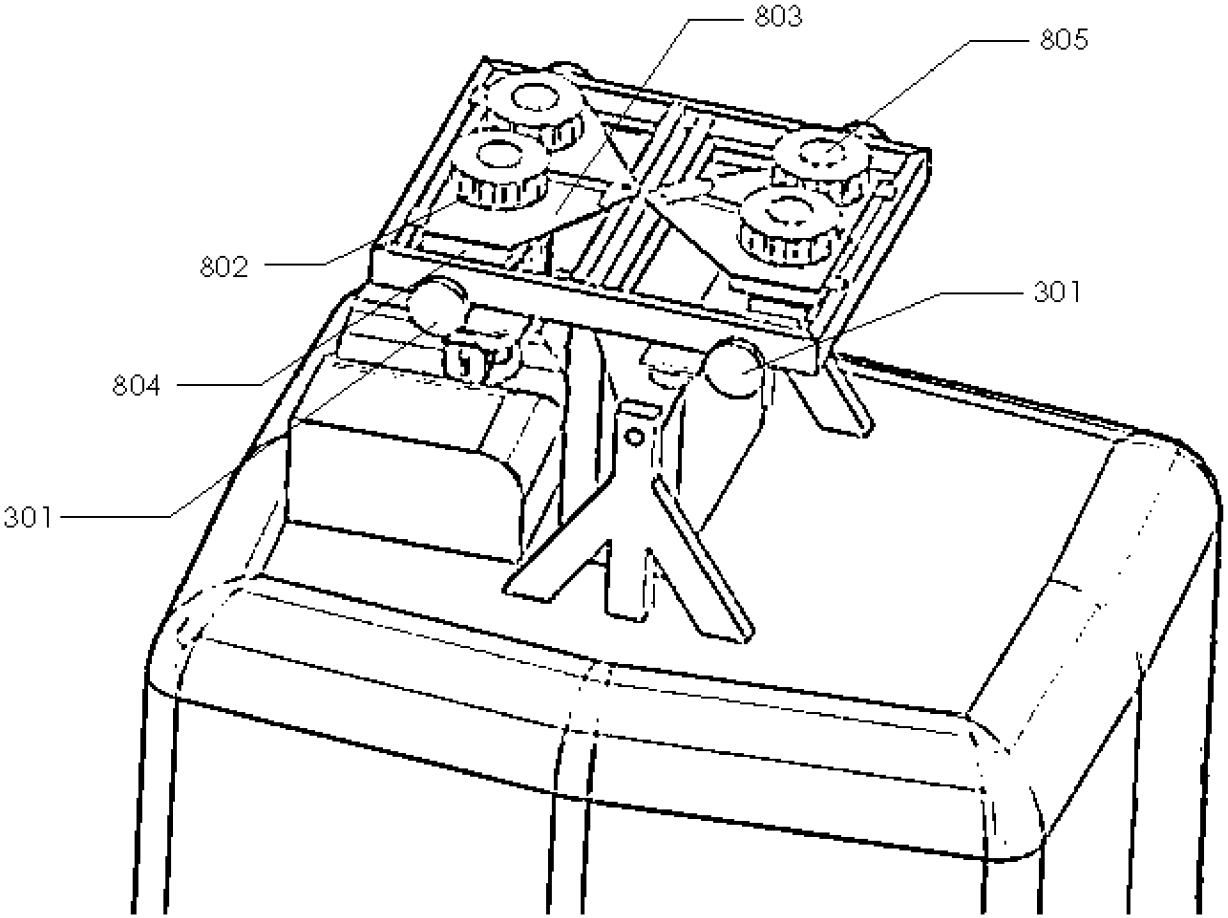
FIG. 10 is a top perspective view of the rider carriage with the roller pinons.
Figure 11:
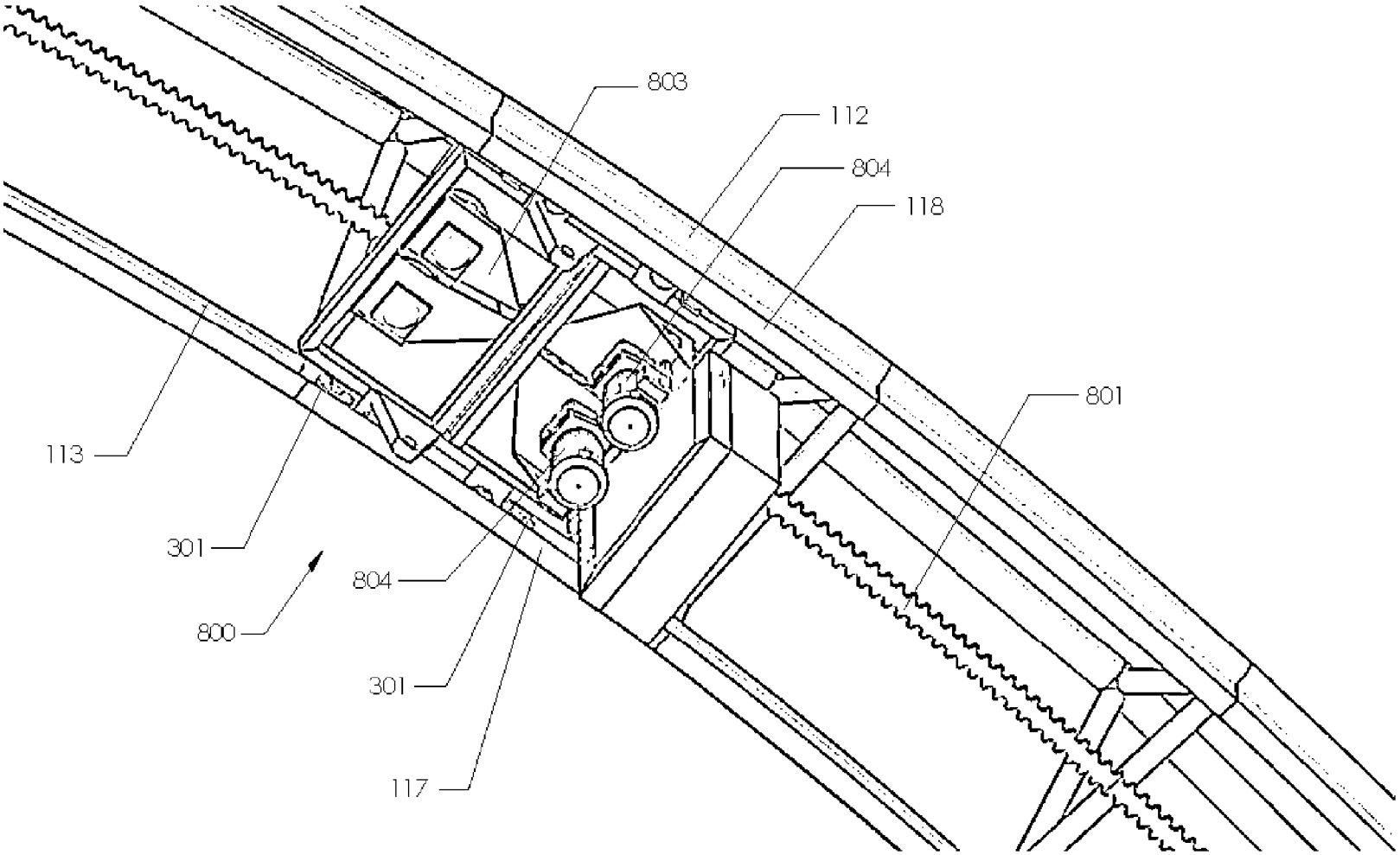
FIG. 11 is a bottom perspective view of the drive system on the track.

One example of a type of drive system is shown in FIGS. 9, 10 and 11. A rack and roller pinion drive system 800 is shown. A tri-cord truss track is shown in some of the figures. The system would work with either a tri-cord truss or a four cord truss and no limitation to either is intended or should be inferred. The rack 801 is mounted between the first and second bottom rail 112 and 113. The teeth of rack 801 are best seen in FIG. 11. Drive roller pinions 802 engage with rack 801 and are driven by motors 804. The drive pinions 802 are mounted on an independent floating plate 803 system. The depicted motors are inline gear motors, but other motors mounted in other configurations could be used as well. A second set of roller pinions 805 are mounted on a second set of plates to form an overspeed system. Standard pinions (not shown) could be used as well, however roller pinions are generally quieter and do not require lubrication.

Figure 12:
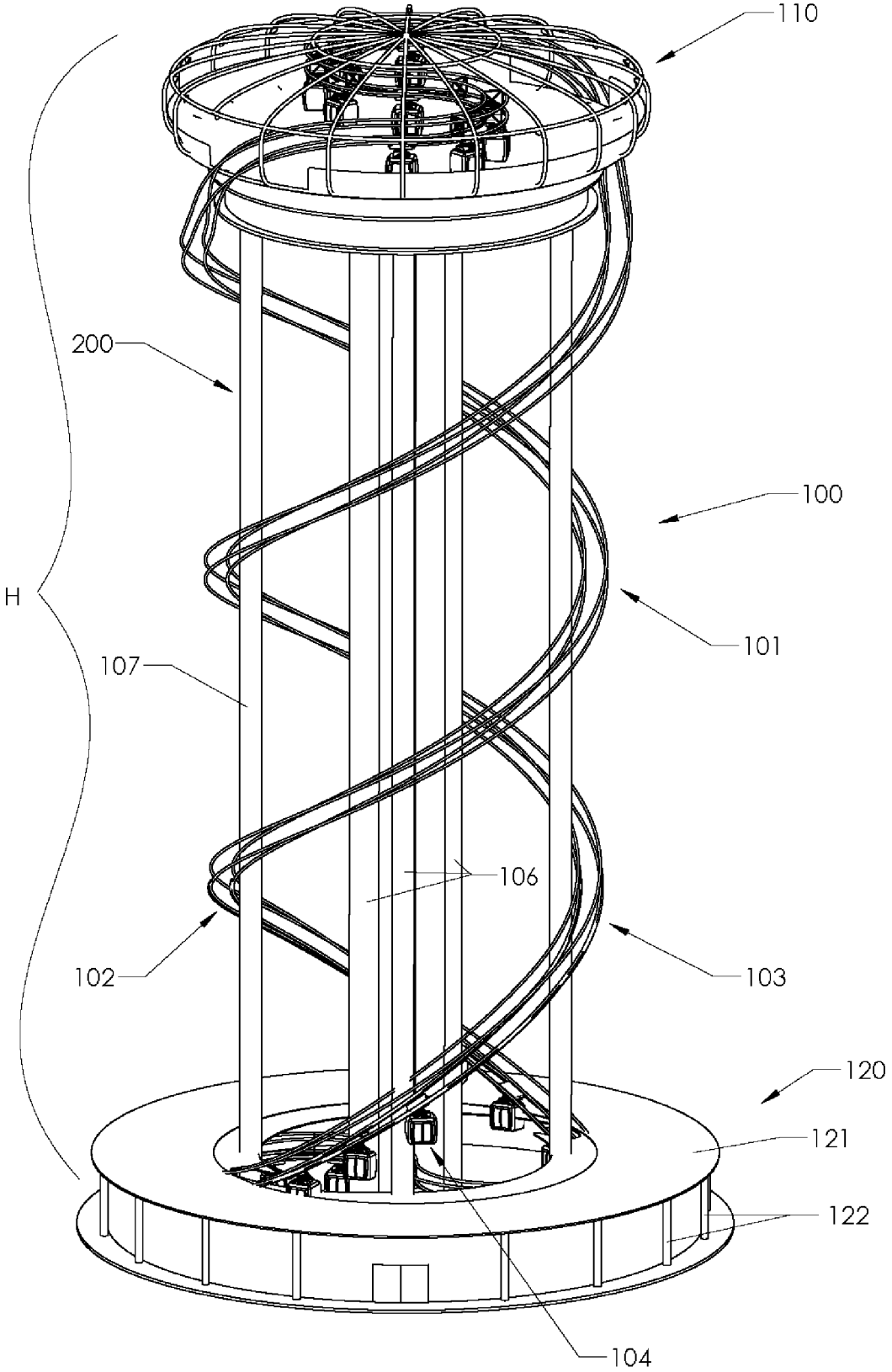
FIG. 12 is a perspective view of a tower ride on a free standing tower.

Referring next to FIG. 12, the tower body 200 is made of at least four central pillars 106 which contain access mechanism either ladders or elevators (not shown). In the depicted embodiment the loading area 120 a roof 121 supported by pillars 122. The access mechanisms allow access to the top of the tower 110 for maintenance. The track 101 is mounted on support pillars 109 which are arranged radially around the central pillars 106. In the depicted embodiment there are four support pillars 109 around the central pillars 106. The number of the support pillars will depend on the weight of the track, the number of rotations it makes around the circumference of the tower, the number of rider carriages the ride has and other design factors. The track 102 is attached to the support pillars 109 with braces (not shown). The size and weight of the rails, supports and braces are chosen to hold the weight of the loaded rider carriages with acceptable safety tolerances for a given installation. The top of the tower can have a viewing platform 131 that can be accessed by elevators 108. This area can be open to the public, used for private functions or only used for maintenance access, depending on the desired uses of the installation.

Figure 13:
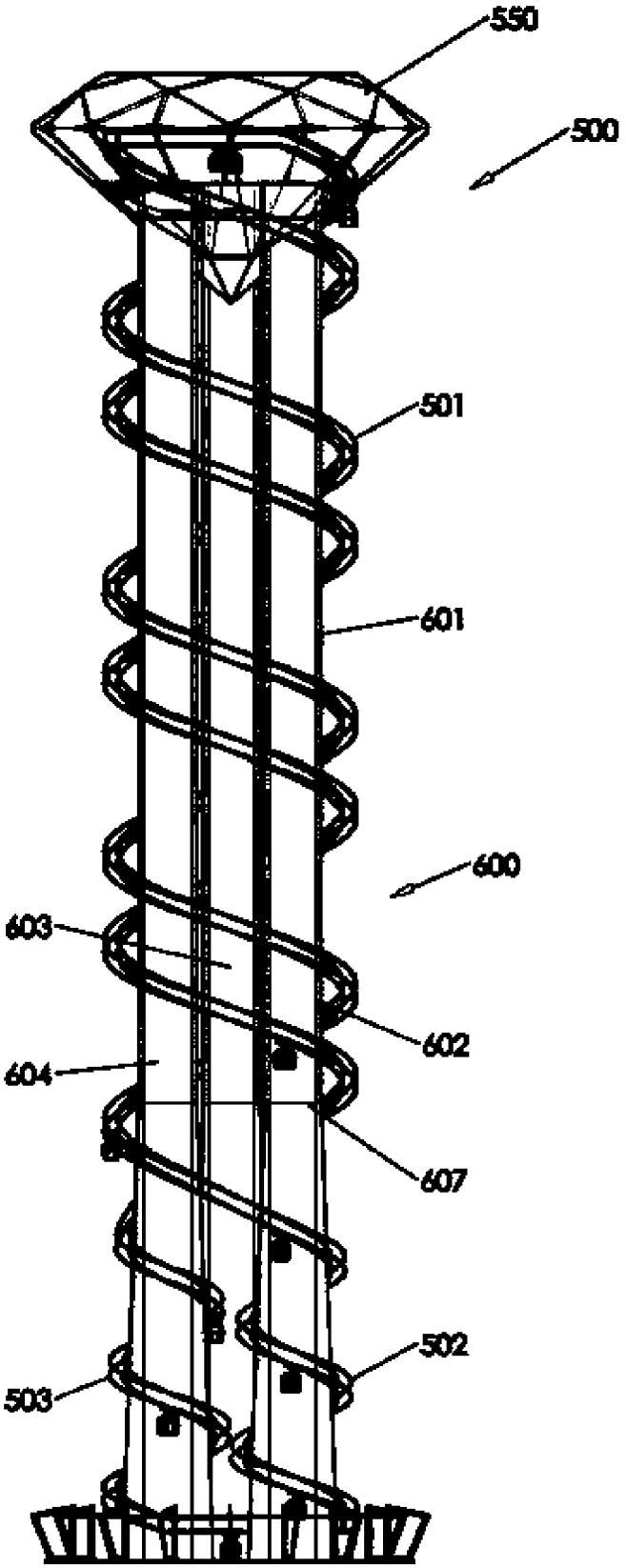
FIG. 13 is a side elevation view of an alternate embodiment of a tower ride.

FIG. 13 is a perspective view of an alternate embodiment of tower amusement ride 500 with a track 501 forming a double helix around the body 601 of the tower 600. In the depicted embodiment the body 201 of the tower is three columns, 602, 603, 604. The amusement ride 500 could also be built on an open tower structure. The track 501 has a first helix section 502 to support the rider carriages 104 going one direction up or down on body of the tower and a second helix section 503 to support the rider carriages going the other direction on the body of the tower. In this embodiment the track 501 starts by winding the first helix section 502 around only one of the columns 602. At a chosen location 607 the first helix section 502 switches to wrap all the way around all three columns. Among other reasons to wrap the track this way, this makes the section of the track that does not have much view (because it is not very high) shorter, since the track is only winding around a single column. This allows the riders to get to the section of the track where they can see more panoramic views faster. The second helix section 503 wraps around column 604 below location 607. If desired, the track could make any number of switches between winding around a single column and around the body 601 of the tower 600 with all three columns. The track 501 can wind around any of the three columns 602, 603 and 604 before switching to winding around all three. For simplicity, the supports between the rails of the track and that attach the track to the columns have been omitted from the drawings.

In the depicted embodiment section 502 is the upward section and 503 is the downward section. However, this is for illustrative purposes only. Depending on the design of the propulsion system, it may be possible to reverse the direction of travel of rider carriages if desired. Which section 502 or 503 is set up as the upward section and which section is the downward section make no difference in the operation of the ride, unlike with prior art rides. First and second helix sections are substantially parallel to each other for a majority of the height H of the body of the tower in the depicted embodiment. The first helix section 502 and second helix section 503 are evenly spaced apart in the depicted embodiment, however as long as there is enough room between the two sections to prevent the rider carriages 104 from coming into contact with the track section below it, other configurations are possible, including not running the track sections parallel, allowing for a wide variety of possible design looks to the ride 500.

Figure 16:
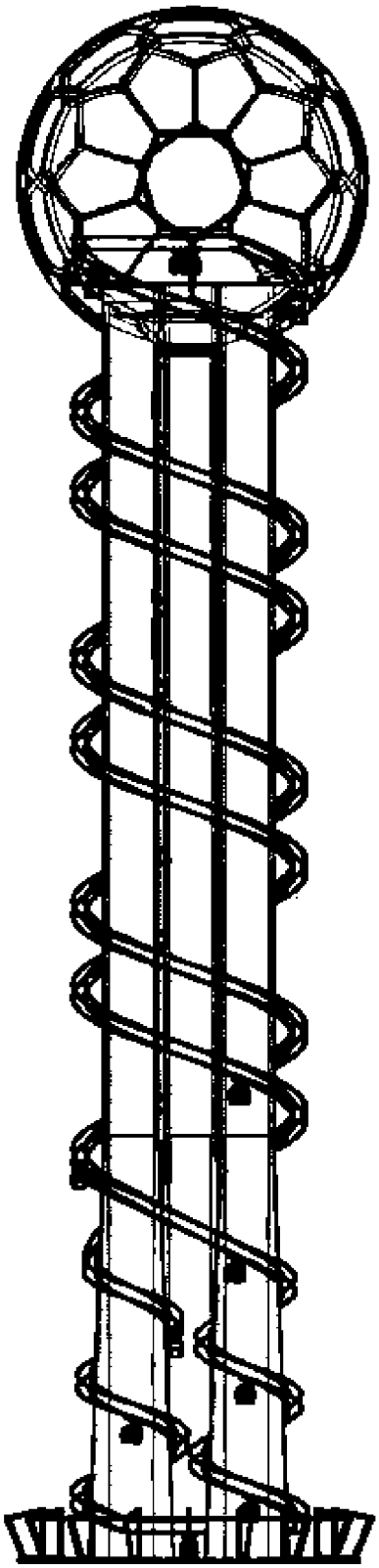
FIG. 16 is side plan view of a possible alternate top.

The top of the ride 550 is shaped like a jewel in the embodiment depicted in FIG. 13. FIG. 16 is a side perspective view of an alternate top with a soccer ball appearance. Many different ornamental designs of the top of the ride are possible. The columns could also be made with an ornamental appearance.

Figure 14:
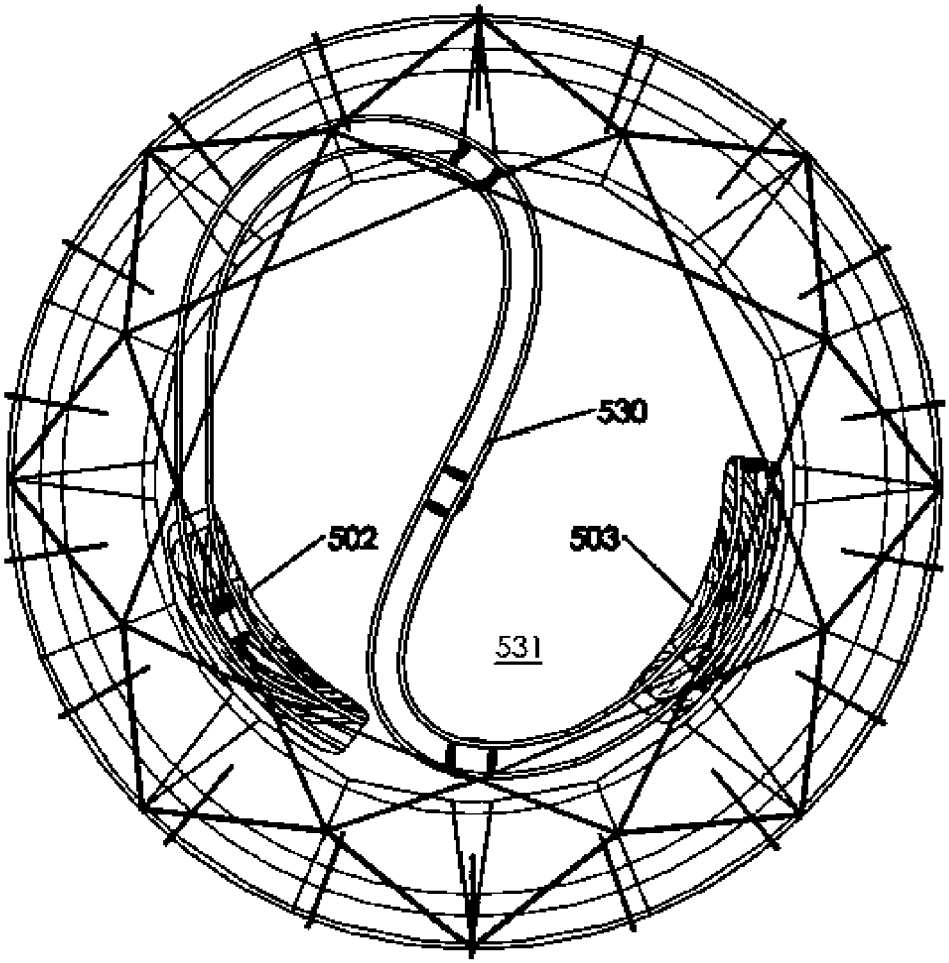
FIG. 14 is a top plan view of the top of FIG. 10.
Figure 15:
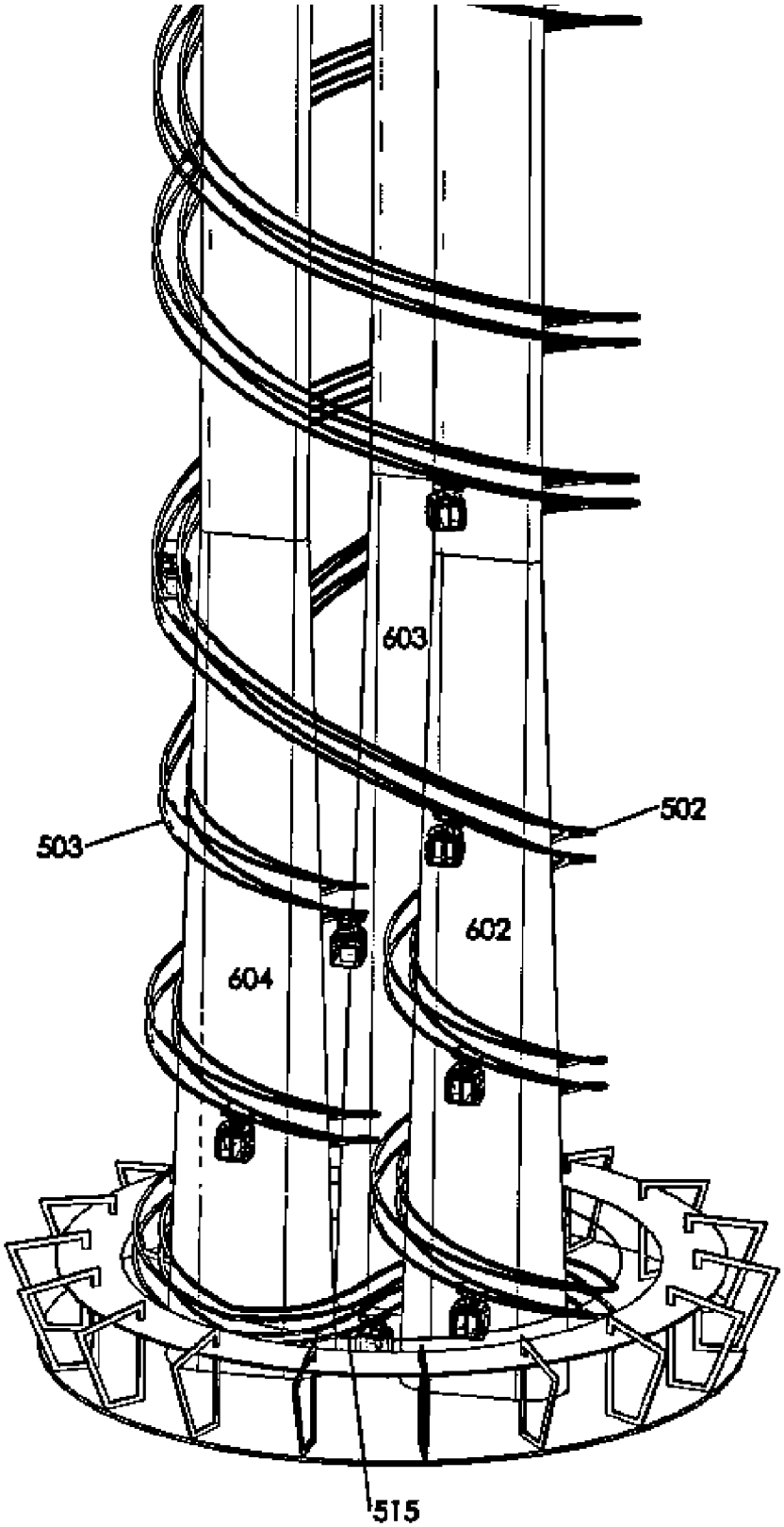
FIG. 15 is a side plan view of the base of the alternate embodiment tower ride.

Referring next to FIGS. 14 and 15, a second S curve section 530 joins the two helix sections 502, 503 at the top of the tower and a first S curve section 515 join the two helix section 502, 503 as discussed above with S curve sections 115 and 130. The S curve 515 is moved among the base of the pillars 602, 603, 604. The second S curve again changes which rails are on the outside and inside of the track 501 as discussed in relation to first S curve section 115, completing smooth loop with no changes of track needed and allowing a helical track in both directions. The area at the top of the tower 500 that the rider carriages 104 move over has a floor 534. If desired, the ride can be configured to allow riders out at the top of the tower 500. This would allow the ride up and the ride down the tower to be two different, ticketed rides.

Figure 17:
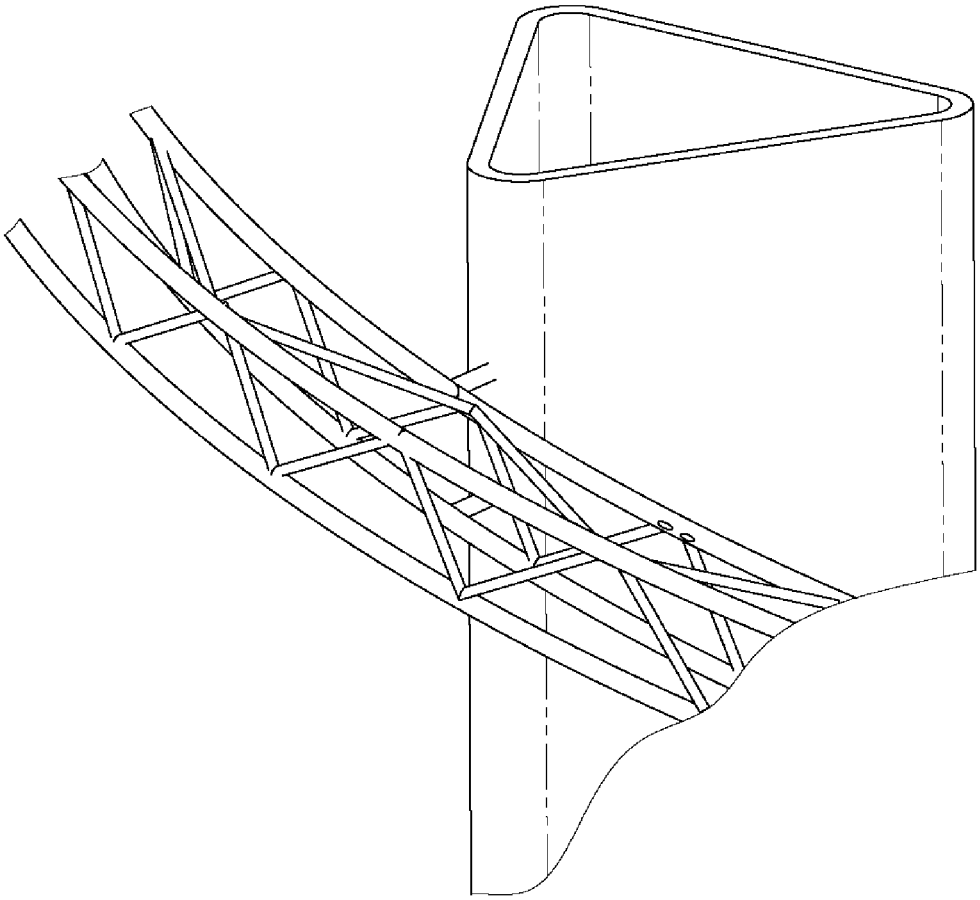
FIG. 17 is a close up view of the track attached to a pillar.

FIG. 17 is a close up view of one segment of the track attached to one of the columns. One set of possible track bracing configuration is shown. The depicted embodiment has triangle cross bracing, but other possible bracing patterns could be used.

The depicted embodiments of FIGS. 1 and 9 are discuss using the tracks 101, 501 for a viewing ride, with the rider carriages moving slowly and more or less at a continuous speed. In an alternate embodiment the tracks 101, 501 could be used for a combined viewing ride and coaster type ride. In this embodiment the up helical section would move the rider carriages up to the top of the ride slowly, allowing for viewing. When the rider carriages reached the end of the top S curve and started down the section helical section, the rider carriages would be disengaged from the drive means (possibly a chain drive or other known drive means) and let go down the second helical section in free fall down the track as in a roller coaster. The rider carriages would most likely be in a linked chain of carriages for this embodiment. The rider carriages could either hang underneath the track as discussed above or ride mounted on the top two rails as in a standard coaster or a tri-cord truss could be used as discussed below.

Figure 18:
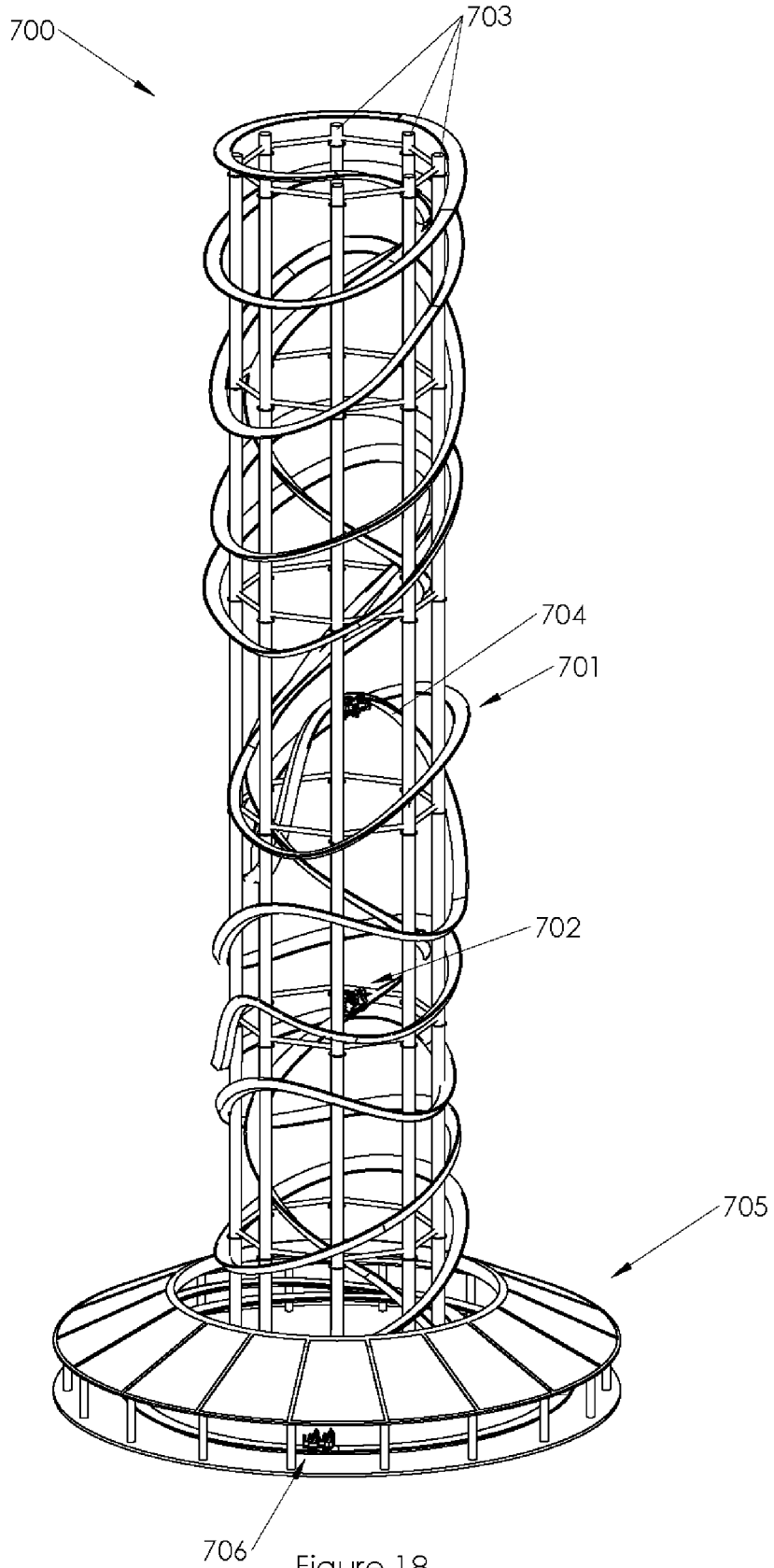
FIG. 18 is a perspective view of a roller coaster embodiment of a tower ride.

Another possible embodiment would be to use the tower for supporting a more standard coaster track to create a coaster tower 700, as seen in FIG. 18. In the majority of the views of the tower 700 the supports that link the rails together and to the tower are not shown to allow for easier viewing of the rails of the track. In a tower coaster embodiment a tri-cord truss could be used as the track 701, or a four rail track as above (not shown). Rider carriages 702 can be run on the track singly or in linked together in trains (not shown). The number and spacing of the supports on the track 701 will be determined by standard engineering considerations such as weight of the rider carriages 702, number of rider carriages 702 on the track 701 and the maximum loading that will be allowed in the rider carriages 702. In this embodiment the tower is formed of eight pillars 703. More or less pillars could be used depending on the engineering needed for the ride. No limitation to the number or form of the pillars 703 is intended or should be inferred. In this embodiment the track runs on both the outside diameter of the pillars and the inside diameter of the pillars, giving more room and options to vary the angle and pitch of the track and allowing upside-down sections 704 of the track 701. In the depicted embodiment the track is a continuous loop, so one segment of track 701 would have to be a driven section of the track 701 to raise the cars from the top of the tower 700 from ground level. One rider carriage 702 is shown going up the track while another is going down. Using the known spacing and breaking technology of the coaster industry, it is expected that two or more trains of rider carriages could be used on the same track 701. In this instance the down section of the track would be a free fall section as above. At the base of the tower 705 a loading area 706 is provided to load and unload passengers.

Figure 19:
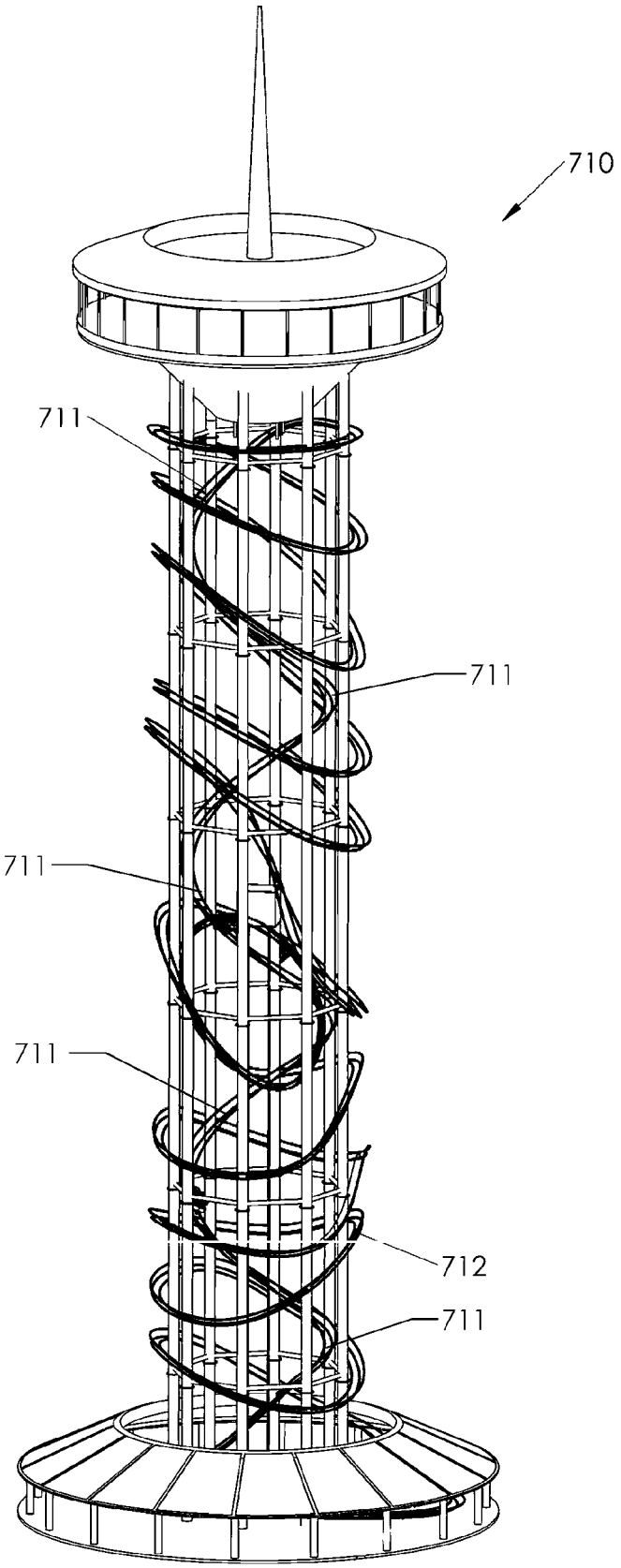
FIG. 19 is a perspective view of a roller coaster embodiment of a tower ride with a spiral inner track.

In an alternate configuration of the tower 710 track 701, the section of the track 711 that was driven and moved the carriages upward would be in the inner diameter and would be simple spiral, as seen in FIG. 19. The outer section 712 would be loop and change pitch as shown for a coaster ride down the tower 710.

Figure 20:
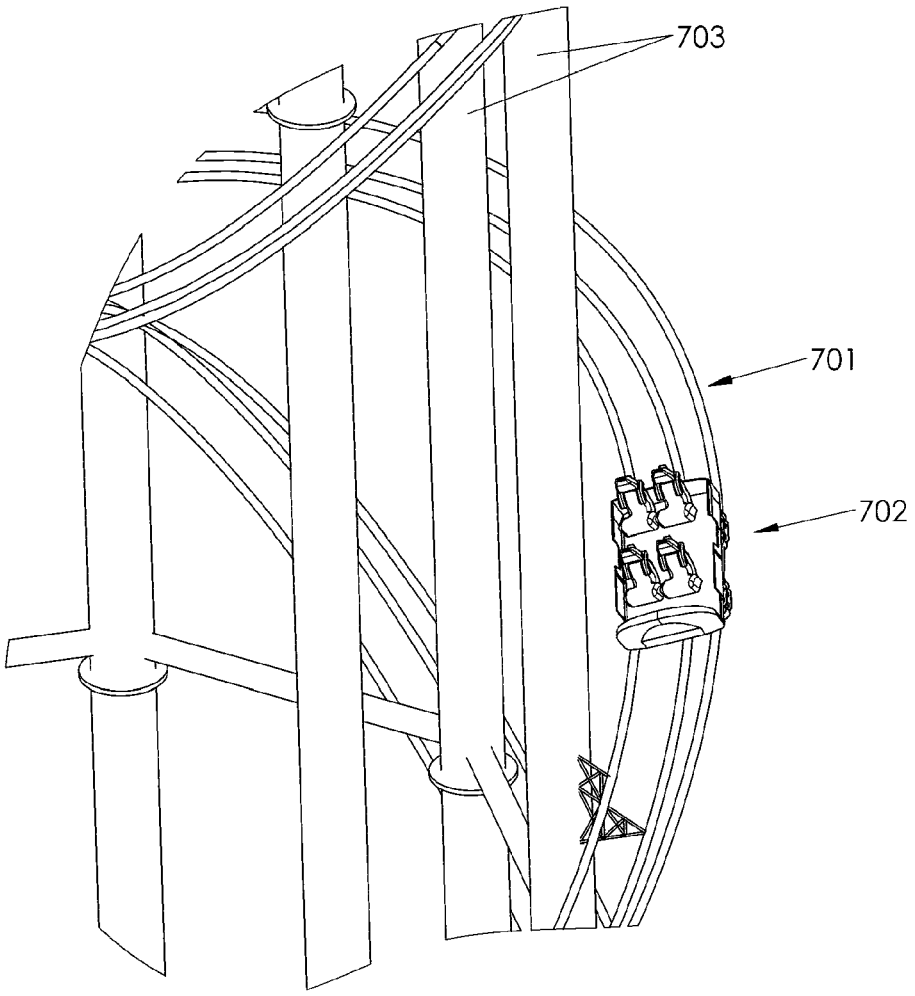
FIG. 20 is a schematic view of a close up of a car on the track.

Referring next to FIG. 20, a close up of the track 701 shows the rider carriage 702 going down the track 701. In the depicted embodiment a single rider carriage 702 to simplify the drawings, as well as not showing the connectors between the rails of the track 701. No limitation to the number of cars should be inferred.

Figure 21:
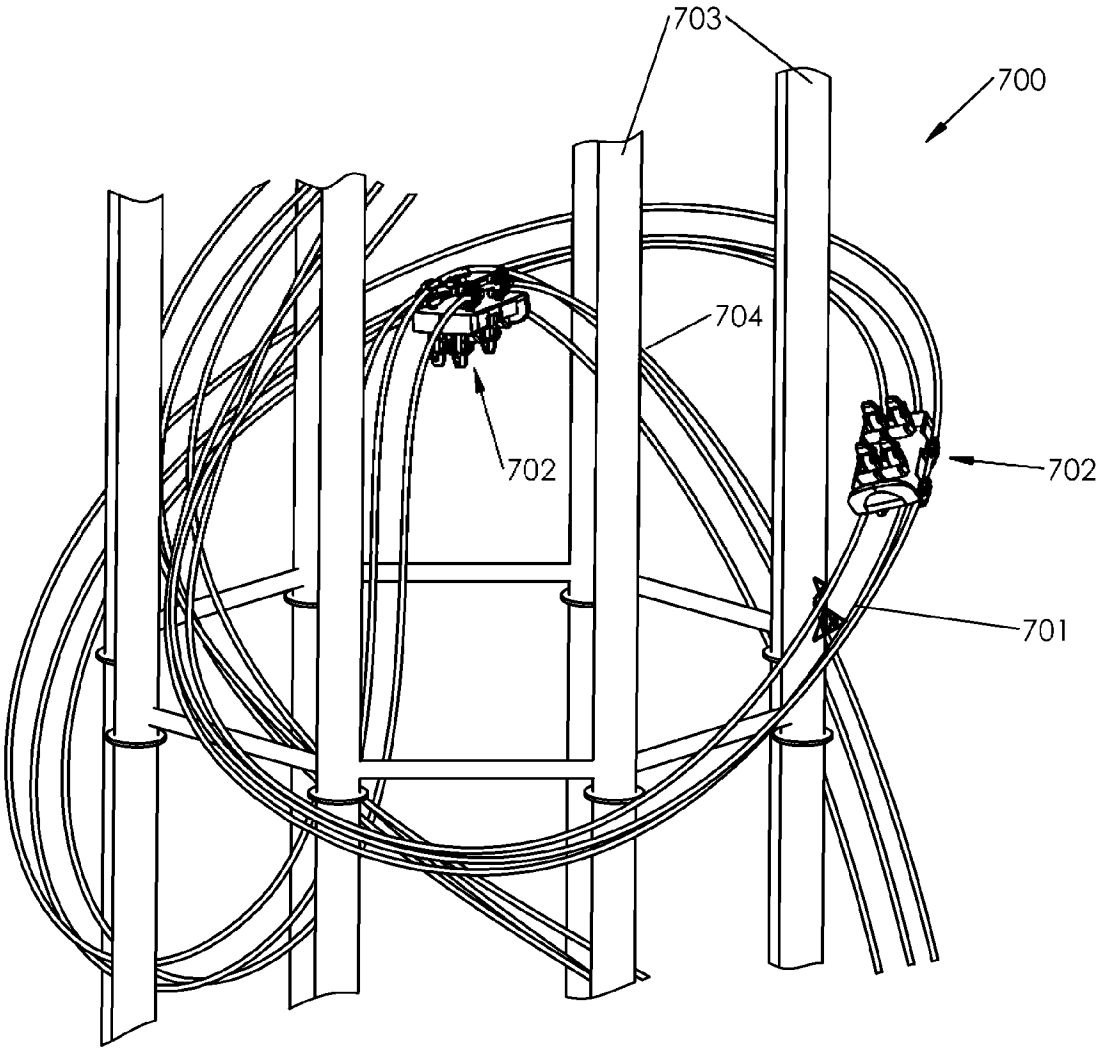
FIG. 21 schematic view of another section of track with a car on both the lower and upper sections.

A close up of an upside-down section 704 of the track 701 is shown in FIG. 21. Two rider carriages 702 are shown going down the two sections of the track 701 at the same time. An additional embodiment of the invention would be to use elevators (not shown) or similar means to raise the rider carriages 702 to the tower and then to use the two separate sections of the track as two different downward roller coaster tracks. This could allow more riders per time hour on the ride and would allow what was essentially to separate rides to occupy the same space. If desired the two tracks could actually be place on the outside and inside of an actual tower building, allowing for even greater differences between the two tracks and one would have an inside controlled environment with all the possibilities that allows and the other being an outside track with the view.

Figure 22:
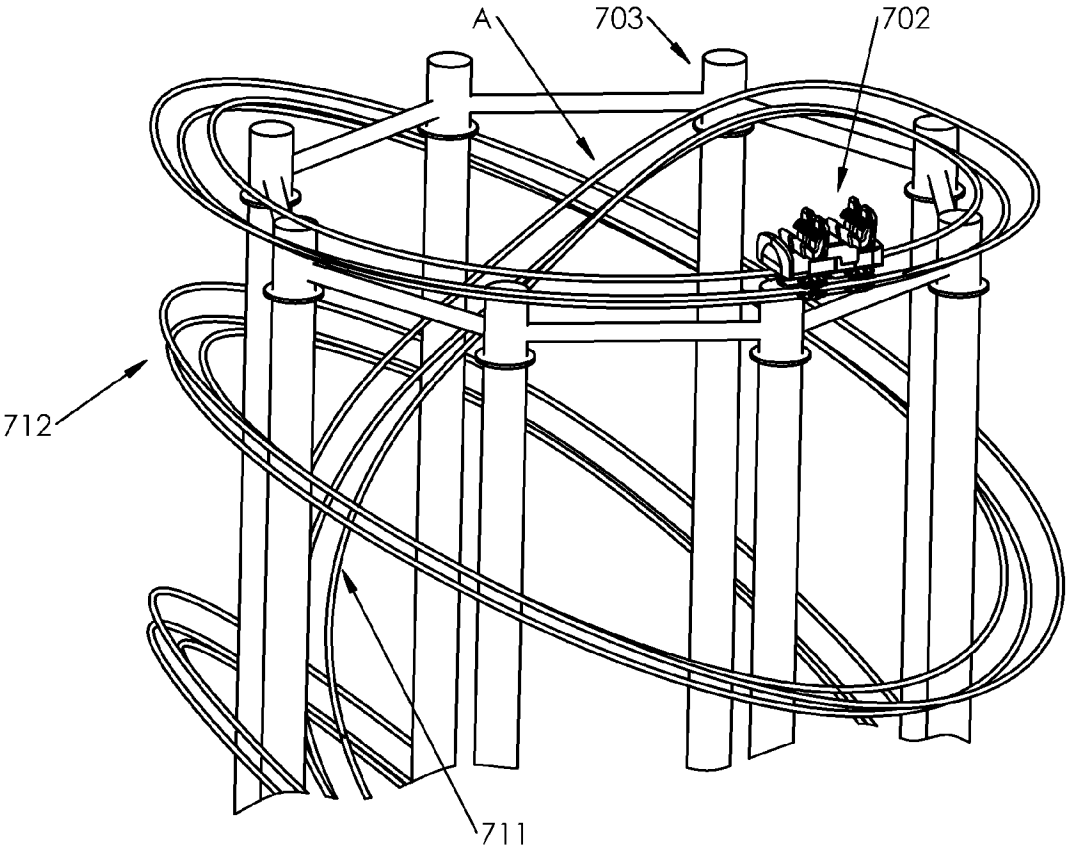
FIG. 22 is a schematic view of the top of the track section.

Referring next to FIG. 22, the top of the track 701 is shown with the track 701 coming up inside in section 711 and down the outer diameter in section 712. Since this is a roller coaster version and twisting of the orientation of the rider carriage 702 is acceptable and even desired, the tri-cord truss track can more easily be used. The switch of the track from the up to the down direction is also simplified in the roller coaster version because both the inside and the outside diameter of the tower can be used and the tracks can overlap as is seen at location A in the drawings.

Figure 23:
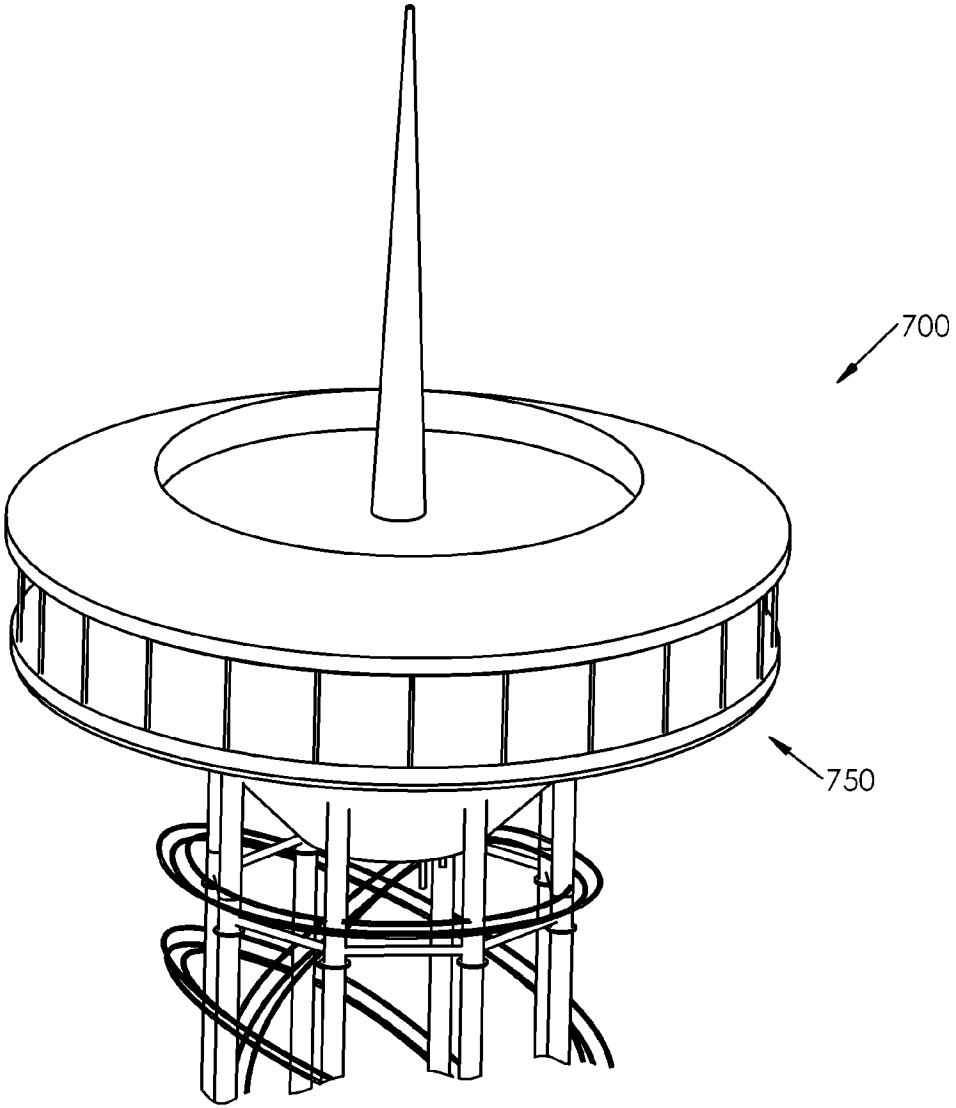
FIG. 23 is a schematic view of the top of the tower with an observation platform.

If desired the top of the tower 700 could have an enclosed space 750 that would be accessed by elevators/stairs. The enclosed space 750 could be an observational platform, restaurant/shopping area or other retail space as seen in FIG. 23.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. An amusement ride comprising:

a support tower;

a track mounted on the support tower having a first rail and a second rail, said rails being substantially parallel to each other;

a first helical section of the track wherein the first rail is an inner rail mounted on the support tower and the second rail is an outer rail spaced radially outward from the inner rail, wherein the first section of the track is a helix wrapping around at least a portion the tower;

a second helical section of track mounted on the support tower wherein the second rail is the inner rail and the first rail is the an outer rail spaced radially outward from the inner rail, wherein the second section of the track is a helix wrapping around at least a portion of the tower;

the first and second sections of track being connected together at a top of the support tower by a first switch back section and at a bottom of the support tower by a second switch back such that a rider carriage moveably mounted on the rails can move in a continuous loop on the rails and such that a first side of the rider carriage is facing outward on the first helical section of the track and a second side of the rider carriage is facing outward on the second helical section of the track, the first and second sides of the ride carriage being opposite each other;

wherein the first section and second section are evenly spaced apart for a majority of the length of the sections;

a plurality of rider carriages suspended below the rails and pivotally attached to a mounting section, said mounting section being slidably attached to the bottom rails; and the rider carriages having a door on opposing sides of the rider carriage.

2. The amusement ride of claim 1 wherein the switch back sections are S curves.

3. The amusement ride of claim 1 wherein said track does not cross over itself.

4. The amusement ride of claim 1, wherein the support tower is a building.

5. The amusement ride of claim 1, wherein the support tower comprises a plurality of support pillars radially spaced around at least one central pillar.

6. The amusement ride of claim 1 wherein the track is a tri-cord truss.

7. The amusement ride of claim 1 wherein the track is a four cord truss.

8. An amusement ride comprising:

a generally double helix shaped, continuous track having a first helical portion and a second helical portion; and a plurality of rider carriages having a first side and an opposite second side that is displaceable on said track and wherein said first side is positioned facing radially outwardly while traversing said first helical portion of said track in said first direction and said second side is positioned radially outwardly while traversing said second helical portion of said continuous track in said first direction;

the plurality of rider carriages suspended below the track and pivotally attached to a mounting section, said mounting section being slidably attached to the track;

the plurality of rider carriages having a door on opposing sides of the rider carriages; and wherein said track does not cross over itself.

9. The amusement ride of claim 8 wherein the first and second helical sections are connected with S curves.

10. The amusement ride of claim 8 further comprising the track being mounted on a support tower.

11. The amusement ride of claim 10, wherein the support tower is a building.

12. The amusement ride of claim 10, wherein the support tower comprises a plurality of support pillars radially spaced around at least one central pillar.

13. The amusement ride of claim 8 wherein the track is a tri-cord truss.

14. The amusement ride of claim 1 wherein the track is a four cord truss.

15. An amusement ride comprising:

a support tower having a top portion, a bottom portion and at least one generally cylindrical sidewall portion extending between said top portion and said bottom portion;

a continuous track mounted on said support tower and adapted to receive a rider carriage suspended beneath said track and having a first side and an opposite second side, said track comprising:

a first helical portion having opposite ends and wrapped about said sidewall portion;

a second helical portion having opposite ends and wrapped about said sidewall portion;

a first switchback portion connecting a first end of said first helical portion to a first end of said second helical portion, wherein a rider carriage moving through said first switchback portion has the relative radial positions of said first and second sides of said carriage reversed by traversing said first switchback portion; and said rider carriage having doors on each of said first and second sides.

16. The amusement ride of claim 15 wherein the first and second helical sections are connected with S curves.

17. The amusement ride of claim 15, wherein the support tower is a building.

18. The amusement ride of claim 15, wherein the support tower comprises a plurality of support pillars radially spaced around at least one central pillar.

* * * * *